United States Patent [19]

Gerber

[11] 4,436,013

[45] Mar. 13, 1984

[54] RECIPROCATING CUTTING APPARATUS WITH THETA DITHER

[75] Inventor: Heinz J. Gerber, West Hartford, Conn.

[73] Assignee: Gerber Garment Technology, Inc., South Windsor, Conn.

[21] Appl. No.: 325,673

[22] Filed: Nov. 30, 1981

[51] Int. Cl.[3] ..... B26D 7/01; B22B 3/00

[52] U.S. Cl. ..... 83/747; 83/925 CC; 83/780; 83/644; 30/275

[58] Field of Search ..... 83/747, 441.1, 925 CC, 83/776, 777, 779, 780, 647, 647.5, 644; 30/275, 273

[56] References Cited

U.S. PATENT DOCUMENTS 685,329 10/1901 Gury ..... 30/275

1,923,834 8/1933 Lefkowitz et al. ..... 30/275

2,239,291 4/1941 Martin ..... 30/273

*Primary Examiner*—E. R. Kazenske

*Assistant Examiner*—Hien H. Phan

*Attorney, Agent, or Firm*—McCormick, Paulding & Huber

[57] ABSTRACT

An apparatus for cutting sheet material spread in one or more layers over a supporting surface uses a reciprocating cutting blade cutter movable in two coordinate directions in the plane of the supporting surface to enable the cutting blade to follow a desired line of cut relative to the sheet material. The cutting blade has a leading cutting edge that performs the actual cutting operation with a slicing action. During the cutting operation, mechanical means within the apparatus produces blade dither about the axis of reciprocation in synchronism with the reciprocation strokes of the blade.

11 Claims, 6 Drawing Figures

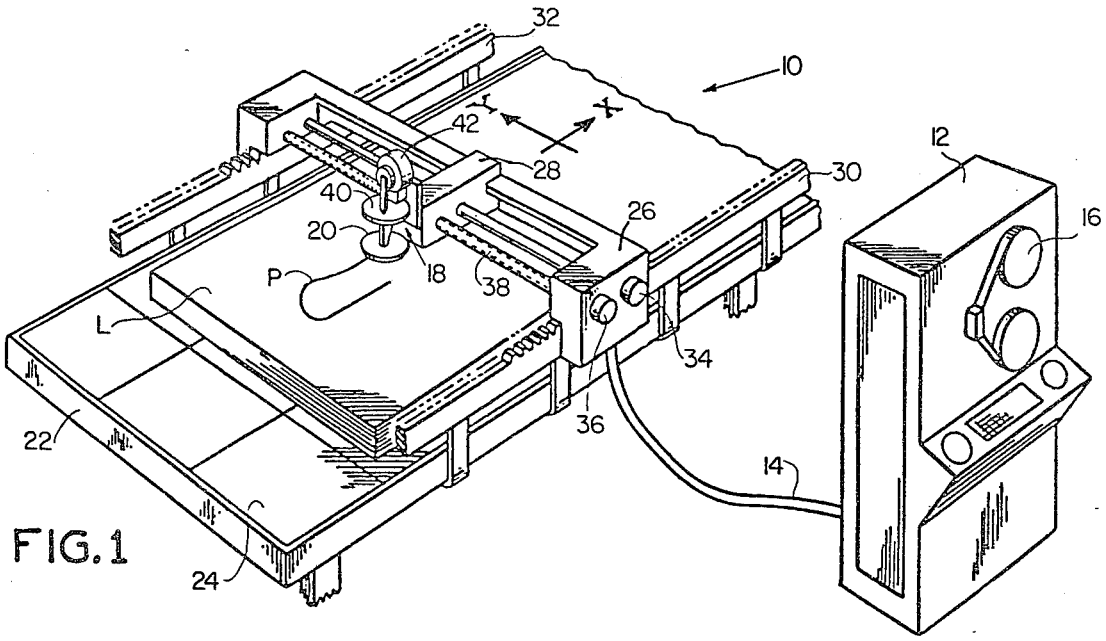
FIG. 1
FIG. 6
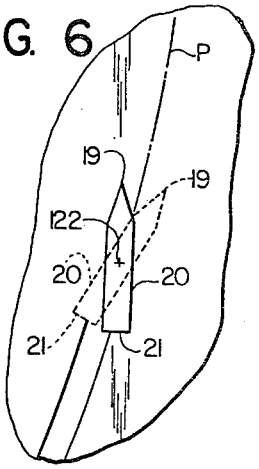
FIG. 5
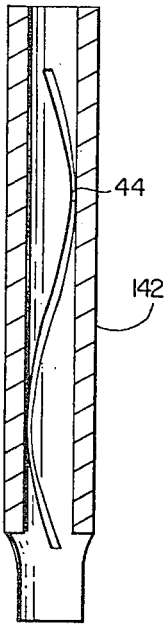
FIG. 3
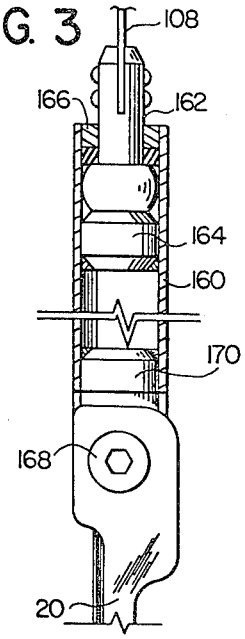
FIG. 4
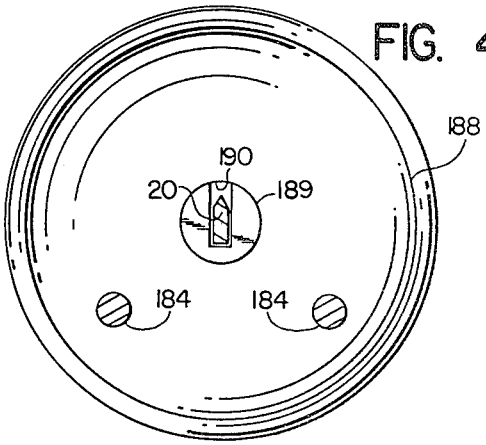

RECIPROCATING CUTTING APPARATUS WITH THETA DITHER

BACKGROUND OF THE INVENTION

This invention relates to a method and apparatus for cutting sheet material, such as garment or upholstery fabrics, and deals more particularly with an apparatus and method utilizing a cutter with a reciprocating cutting blade.

The type of apparatus with which this invention is concerned may be used for cutting garment or upholstry pieces and the like from either a layup of sheet material arranged in vertically stacked relationship or from a single sheet which is spread out in a generally flat condition prior to the cutting operation. The supporting surface for the sheet material is generally arranged horizontally and the cutter is supported above the sheet material for movement in two coordinate directions parallel to the supporting surface to enable the cutting blade to be moved along any desired line of cut in the sheet material. As the cutter is moved along the desired line of cut, the cutting blade engages the sheet material and is reciprocated to execute the actual cutting action.

It is common to cut spread sheet material with a reciprocating-blade cutter so that the blade cuts with a slicing action as the blade reciprocates perpendicularly to the plane of the sheet material. The cutting blade has a leading cutting edge parallel to the axis of reciprocation and the fabric is cut as the leading edge is urged progressively into the sheet material along a desired line of cut.

In some circumstances, it is desirable to dither the blade, that is, to intermittently and rapidly rotate the blade by preselected amounts about a position in alignment with or tangent to the cutting path without transversing a substantial segment of the cutting path during rotation. Dithering is desirable when, for example, the cutting blade is experiencing unbalanced lateral loading from limp sheet material due to the absence or lack of lateral support at one side of the blade near the edges of the layup or at closely adjacent cuts, or when the blade loading is unbalanced because of anisotropic material characteristics. The abrupt rotation as the blade advances cuts the material in a stepwise fashion and relieves the loading and blade stress caused by the material.

U.S. Pat. No. 4,133,234, having the same inventor as this invention, describes a computer-controlled method for obtaining abrupt rotational movements, or dither, of a reciprocating blade. In that patent, a $\theta$-servomotor adapted to rotate the blade about a vertical axis produces blade dither in response to command signals from a control computer. In order to produce blade dither, however, several cutting assembly elements, including the sleeve in which the blade reciprocates, the presser foot, and selected rotational drive components, must be abruptly rotated in conjunction with the blade. Necessary movement of these several cutting elements contributes to a high dither load on the $\theta$-servomotor, and, accordingly, a high level of electrical power is required. If the dither load is so high that the $\theta$-servomotor is excessively large in size or a second servomotor is required to perform the dither function, the servomotor weight, entirely supported by the movable carriages, hinders rapid response of the carriages to movement commands.

It is, therefore, an object of this invention to provide a reciprocating cutter for sheet material which provides blade dither with less power consumption than is required by previous cutters.

SUMMARY OF THE INVENTION

This invention resides in an apparatus for cutting sheet material. The apparatus includes a reciprocating cutting tool that is movable along a desired line of cut relative to a supporting surface on which the sheet material to be cut is spread. The cutting tool is supported for reciprocation along an axis generally perpendicular to the support surface and includes a leading cutting edge and a trailing edge. Motive means are provided for translating the cutting tool progressively along a desired line of cut. The apparatus also includes means for reciprocating the tool in alternate upward and downward strokes between upper and lower limits of travel and, in accordance with this invention, mechanical means are provided for deriving cutting blade dither from the reciprocation strokes of a blade.

The mechanical means for deriving blade dither generates new frictional forces which are not present in cutters which utilize the $\theta$-servomotor to produce blade dither. However, the power to overcome the new friction forces is not nearly as large as the power required from the $\theta$-servomotor to dither the blade and the associated drive and support structure. Friction in the rotational drive system and between the presser foot and the sheet material imposes a significant load on the servomotor in the prior art system, but that same friction in the present invention reduces rather than adds to the dithering loads reacted to the $\theta$-servomotor. Hence, a primary advantage of this invention is that the power required to produce blade dither is significantly reduced from the power required to produce blade dither. in prior art cutters. Also, the increased power needed in the reciprocating means represents a small fraction of its required power. Thus, the present invention can be implemented with little or no increase in the capacity of the reciprocating means.

BRIEF DESCRIPTION OF THE DRAWINGS

FIG. 1 is a perspective view of a cutting apparatus in which the present invention resides.

FIG. 3 is a fragmentary view partially in section of the reciprocating drive linkage connected to the cutting blade of the apparatus.

FIG. 4 is a cross-sectional view of the blade and presser foot as viewed along the sectioning line 4–4 of FIG. 2.

FIG. 5 is a cross-sectional view of a slotted blade sleeve.

FIG. 6 is a plan view of a layup and illustrates a cutting blade advancing along a line of cut.

DETAILED DESCRIPTION OF THE PREFERRED EMBODIMENTS

Figure 2:
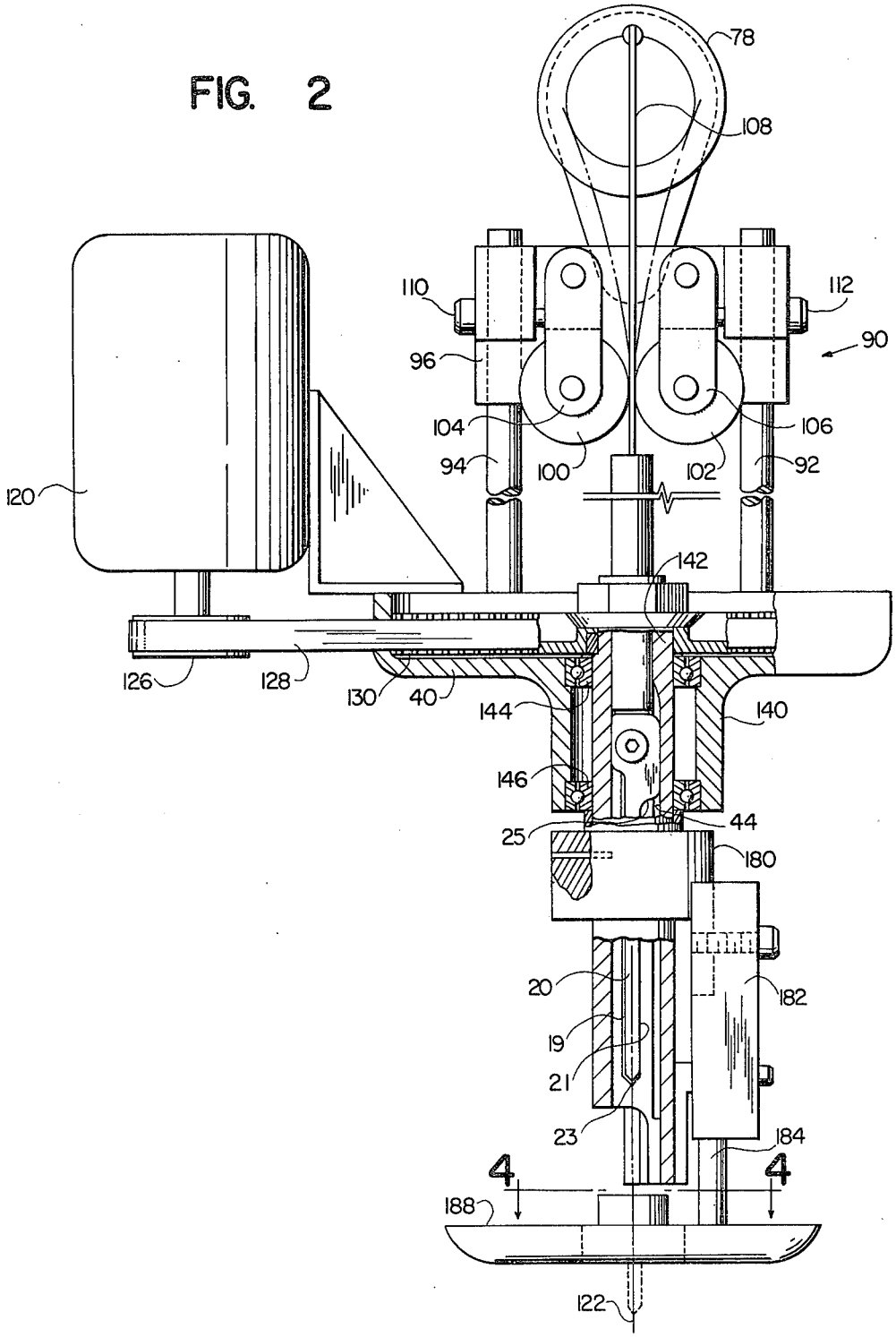
FIG. 2 is a side elevation view, partially in section, of the cutting head in the apparatus of FIG. 1.

FIG. 1 illustrates an automatically controlled cutting machine, generally designated 10, of the type shown and described in greater detail in U.S. Pat. No. 3,495,492, having the same assignee as the present invention. The cutting machine 10 is utilized to cut multiply layups L of sheet material such s woven and nonwoven fabrics, paper, cardboard, leather, rubber and synthetics. The illustrated machine 10 is a numerically controlled machine connected with a controller 12 by means of an electrical cable 14. The controller 12 takes data from a program tape 16 and converts that data into machine commands for guiding a cutting head 18 with a reciprocating cutting blade 20 along a cutting path P defined by the program tape 16. The cutting path may, for example, be the periphery of a pattern piece forming part of a garment or a panel of upholstery.

The cutting machine 10 includes a table 22 having a penetrable bed 24 defining the support surface for the layup L during cutting. The bed 24 may be comprised of a Styrofoam material or preferably a bed of bristles which is easily penetrated by the reciprocating cutting blade 20 without damage to either while the cutting path P is traversed. The bed may also employ a vacuum system such as illustrated and described in greater detail in the above-referenced U.S. Pat. No. 3,495,492, for holding the layup firmly in position.

The cutting head 18 with its cutting blade 20 is suspended above the support surface of the table 22 by means of an X-carriage 26 and a Y-carriage 28. The X-carriage 26 translates back and forth in the illustrated X coordinate direction on a set of racks 30 and 32 which are engaged by a Y-drive motor 34 energized by command signals from the controller 12. The Y-carriage 28 is mounted on the X-carriage 26 for movement relative to the X-carriage in the Y-coordinate direction and is translated by the Y-drive motor 36 and a lead screw 38 connected between the motor and carriage. Like the drive motor 34, the drive motor 36 is also energized by command signals from the controller 12. Thus, coordinated movements of the carriages 26 and 28 translate the cutting blade 20 along a cutting path over any area of the table 22.

The cutting blade 20 is suspended in cantilever fashion from an adjustable platform 40 attached to the projecting end of the Y-carriage 28. The adjustable platform elevates the sharp, leading cutting edge of the blade into and out of cutting engagement with the sheet material. The blade is reciprocated by means of a drive motor 42 supported on the platform 40. Another motor (not shown in FIG. 1) on the platform rotates or orients the blade about a $\theta$-axis perpendicular to the sheet material and generally aligns the blade with the cutting path.

FIG. 2 illustrates in detail the structure by which the cutting blade 20 is mounted for reciprocation, plunging and lifting and rotation relative to the mounting platform 40. The reciprocation drive motor 42 of FIG. 1 is connected in driving relationship with the blade 20 by means of an eccentric 78. Although not shown in FIG. 2, the drive motor 42 is supported by the platform 40 and the shaft of the drive motor is keyed directly with the eccentric 78. The reciprocating drive linkage between the eccentric 78 and the blade 20 passes through a guide assembly 90. The guide assembly 90 is supported from the platform 40 on a pair of fixed slide rods 92 and 94 and includes a blade guide plate 96 which is moved downwardly on the rods by another motor (not shown) to lower the blade into cutting engagement with the sheet material. A pair of guide rollers 100, 102 are pendularly supported from the plate 96 by means of links 104 and 106, respectively, and are pressed by a pair of springs (not shown) against a flexible link 108 forming the upper portion of the reciprocating drive linkage to the blade. The compression of the springs can be varied by cap screws 110, 112 to establish a centered position for the rollers 100 and 102. Further illustrations and description of the blade support mechanism can be found in U.S. Pat. No. 3,955,458, having the same assignee.

It will be readily apparent that the flexible link 108 must bend between the limits illustrated in FIG. 2 as the connecting pin 82 is orbited in the eccentric 78. The guide rollers 100 and 102 establish a reference point through which the linear reciprocating motion of the cutting blade 20 takes place and the departure of the connecting pin 82 from points along the vertical axis through the reference point must be accommodated by the link 108.

An orientation or $\theta$-drive motor 120 is shown mounted to the platform 40 for orienting the blade 20 generally tangent to or in alignment with the cutting path. The cutting blade 20, as described in greater detail below, is suspended for rotation about a $\theta$-axis, or vertical axis, 122 perpendicular to the support surface, and the rotational position or orientation about the axis 122 is controlled by the $\theta$-drive motor during a cutting operation. A drive train interconnecting the blade 20 and the motor 120 includes a toothed pulley 126 on the motor shaft, a toothed pulley 130 connected with the blade 20, as described in greater detail below, and a toothed belt 128 interconnecting the pulleys 126 and 130. Like the X and Y positions of the blade determined by the drive motors 34 and 36, the orientation of the blade must be precisely controlled; therefore, the toothed belt and the pulley system is used and a feedback sensor (not shown) may also be connected to the $\theta$-drive motor 120 to supply position information to the control computer 12 in FIG. 1.

From the description so far, it will be understood that the cutting blade 20 is a reciprocating cutting blade that can be lifted in and out of cutting engagement with the sheet material L positioned on the cutting table 22. The blade 20 is translated along a cutting path in the sheet material in the X-carriage 26 and Y-carriage 28 and is maintained generally in tangential relationship with the cutting path by the $\theta$-drive motor 120.

Referring to FIG. 2, a housing 140, comprising part of the platform 40 encloses the toothed pulley 130 utilized in the control of the orientation of the cutting blade 20 along the cutting path. A hollow shaft or sleeve 142 is mounted for rotation about the $\theta$-axis in the housing 140 by means of roller bearings 144 and 146. The pulley 130 is keyed to the upper end of the sleeve 142 so that the sleeve rotates about the $\theta$-axis 122 in response to the control signals received by the drive motor 120. Rotation of the pulley 130 about the $\theta$-axis 122 causes the blade to rotate correspondingly while the reciprocating motion of the blade takes place in a bore of the sleeve 142.

It will be understood that the flexible link 108 at the upper end of the reciprocating drive linkage cannot rotate with the blade 20 about the $\theta$-axis 122 in view of the connection with the eccentric 78. Accordingly, the portion of the reciprocating drive linkage illustrated in FIG. 3 between the flexible link 108 and the blade 20 must accommodate the relative rotation of the blade and link in addition to transmitting the reciprocation motion between the same elements. The intermediate portion of the linkage is formed by a cylinder 160 having a swiveling end joint formed by a spherical bushing 162 at the upper end of the cylinder. The bushing 162 is connected to the flexible link 108 and is captured in the upper end of the cylinder 160 by a spacer 164 welded to the cylinder and a washer 166 fixed in the end of the cylinder. At the lower end of the cylinder the blade 20 is connected by a screw 168 to a slug 170 also welded in the cylinder. Accordingly, the flexible link 108 transmits reciprocating motions from the drive motor 42 to the blade 20 and the swiveling joint formed by the spherical bushing 162 permits the blade to rotate about the $\theta$-axis 122 in response to the drive motor 120.

Referring to FIG. 2, the cutting blade 20 is vertically elongated and includes a leading cutting edge 19, a trailing edge 21, and, at the lower end, a generally downwardly facing cutting edge 23. Along the trailing edge 21 of the blade is a tang 25, the purpose of which will be hereinafter apparent.

At the lower end of the sleeve 142 in which the blade reciprocates, a flange plate 180 is fixedly secured so that the plate rotates about the $\theta$-axis 122 with the blade. Bolted to one side of the flange plate is a presser foot assembly comprised of a slide bracket 182, slide rods 184, 184 and a presser foot 188. As best shown in FIG. 4, the presser foot 188 has a central cut-out or aperture 190 and an open-sided bushing 189 through which the reciprocated blade 20 extends during a cutting operation. The bushing 189 provides vertical guidance to the blade as the blade reciprocates along its vertical axis of reciprocation. Referring to FIG. 2, the slide rods 184, 184 are fitted loosely within the bracket 182 so that the foot rests on the upper layer of the sheet material under its own weight and prevents the material from lifting in a cutting operation during the up-stroke of the blade.

In accordance with the invention, the blade 20 is dithered, or abruptly rotated back and forth, by mechanical means as the leading cutting edge 19 of the blade oscillates between rightward and leftward limits about the $\theta$-axis 122. For this purpose and with reference to FIGS. 2 and 5, the tang 25 of the blade is received within a contoured camming slot 44 defined along the inside surface of the sleeve 142. The slot extends in the sleeve 142 in the same general direction as the axis of reciprocation of the blade and is slightly greater in length than the summation of the length of the stroke between the upper and lower limits of reciprocation and the length of the tang 25. The slot 44, functioning as a camming surface, and the tang 25, functioning as a cam follower, cooperate to rotate the blade by lmited amounts back and forth about the $\theta$-axis 122 in synchronism with the reciprocation strokes of the blade.

In FIG. 5, the slot 44 is shown spiralling downward in one direction about the inner wall of the sleeve, then reversing and spiralling in the opposite direction, and then again reversing back to the original direction. During a reciprocation cycle, as the blade 20 moves downwardly from the upper bound of its reciprocation stroke where the blade is generally centered on the cutting path, the cutting edge 19 is shifted rightwardly of the cutting path P until the rightward limit of edge oscillation is reached. Upon reaching the rightward limit, the cutting edge 19 is shifted leftwardly until the leftward limit of edge oscillation is reached. From the leftward limit of edge oscillation, the cutting edge is shifted rightwardly until the blade reaches the lower bound of the reciprocation stroke where it is again generally centered on the cutting path. In FIG. 6, the cutting blade is shown in dotted lines near the rightward limit of edge oscillation relative to the cutting path P and is shown in solid lines near the leftward limit of edge oscillation.

After the lower bound of the reciprocation stroke has been reached, the blade begins to travel upwardly, retracing its downward travel. Thus, the leading cutting edge 19 is caused to shift leftwardly, then rightwardly, and finally leftwardly until the cutting edge generally centers itself on the cutting path at the upper bound of the reciprocation stroke. Subsequently, the tang 26 and slot 44 cooperate to repeat in sequence the steps of shifting the cutting edge rightwardly then leftwardly then rightwardly during the downward stroke of the cutting blade, and then leftwardly then rightwardly then leftwardly during the upward stroke of the blade in synchronism with the reciprocation strokes.

It will be noted that the cutting blade 20 illustrated in FIG. 6 is rotated about the $\theta$-axis 122 positioned approximately midway between the leading and trailing edges of the blade. Positioning the axis in this manner minimizes the displacement of the sheet material due to blade rotation and minimizes the twisting moment carried through the blade about the $\theta$-axis. Also by rotating the reciprocating cutting blade about an axis midway between the leading and trailing edges, there is less tendency to produce nonintersecting cuts from consecutive strokes along a curved cutting path.

While the present invention has been described in a preferred embodiment, it will be understood that numerous modifications and substitutions can be made to the specific structure disclosed without departing from the spirit of the invention. For example, although the slot 44 has been described in FIG. 5 as being contoured to rotate the cutting edge of the blade through a rightward and leftward cycle during a single stroke of the cutting blade, the slot can also be contoured to rotate the blade through more than one rightward and leftward cycle during a reciprocation stroke. As a consequence of increasing the number of rightward and leftward cycles per reciprocation stroke, the rate of blade dither increases. Accordingly, the present invention has been described in a preferred embodiment by way of illustration rather than limitation.

I claim:

1. An apparatus for cutting sheet material comprising:

a cutting tool in the form of an elongated cutting blade which reciprocates generally along an axis of reciprocation when performing a cutting operation, the cutting blade having a leading cutting edge and a trailing edge, the cutting edge and trailing edge being generally parallel to the axis of reciprocation;

means defining a support surface for supporting sheet material to be cut by the cutting blade;

means supporting the cutting blade with the axis of reciprocation of the blade generally perpendicular to the support surface;

motive means for translating the cutting blade generally progressively along a desired lie of cut relative to the sheet material on the support surface;

means for reciprocating the cutting blade along the axis of reciprocation in alternate upward and downward strokes between upper and lower limits of travel; and mechanical means interposed between the cutting blade and the blade supporting means for producing from the reciprocation strokes of the blade limited oscillatory rotations of the cutting blade about the axis of reciprocation toward one side of the line of cut and then the other.

2. An apparatus as described in claim 1 wherein:

the mechanical means for deriving cutting blade oscillation rotation comprises camming means for rotating the blade rightwardly and leftwardly between limits of rotational movement and about an axis generally parallel to and between the leading and trailing edges of the blade during each upward and downward reciprocation stroke.

3. An apparatus as described in claim 2 wherein:

the rotational axis of the blade is generally midway between the leading and trailing edges of the blade.

4. An apparatus as described in claim 2 further comprising a blade sleeve supported adjacent the cutting blade, and wherein:

the camming means for rotating the blade between rightward and leftward rotational limits comprises mechanical biasing means operatively connected between the blade and blade sleeve.

5. An apparatus as described in claim 2 wherein:

the camming means for rotating the cutting blade between rotational limits includes a cam supported adjacent the cutting blade and cooperating with the blade to rotate the blade rightwardly and leftwardly in synchronism with the reciprocation strokes of the blade.

6. An apparatus for cutting as described in claim 2 wherein:

the camming means for rotating the blade between rightward and leftward limits includes means supported adjacent the cutting blade and defining a camming slot and an engaging cam follower moved in the slot during reciprocation of the blade.

7. An apparatus for cutting as described in claim 2 wherein:

the cutting blade includes a cam follower having a length parallel to the reciprocation axis, and the camming means for rotating the cutting blade between rotational limits includes a member extending adjacent the cutting blade, the member having a camming slot to slidingly receive the cam follower of the blade, the slot being contoured and extending in the member in the same general direction as the axis of blade reciprocation and being slightly greater in length than the summation of the length of the stroke between the upper and lower limits and the length of the cam follower so that rotation of the blade between rightward and leftward rotational limits is guided by the camming slot and cam follower in conjunction with reciprocation.

8. An apparatus for cutting as defined in claim 7 wherein:

the cam follower is located along the trailing edge of the cutting blade, and the member of the camming means is mounted adjacent the trailing edge of the cutting blade.

9. In a machine for cutting a multi-ply layup of sheet material including a cutting head with a cutting blade, means for reciprocating the blade up and down along an axis generally perpendicular to the sheet material and relative to a blade support in the cutting head when performing a cutting operation, and means for translating the cutting blade along a predetermined cutting path relative to the sheet material, the improvement comprising mechanical means for deriving from the up and down reciprocating motions of the blade limited rotational motions of the blade back and forth about the perpendicular axis from one side of the cutting path to the other, the mechanical means being connected between the blade and the blade support.

10. In a machine for cutting a multi-ply layup of sheet materiall, the improvement of claim 9 wherein the mechanical means comprises a cam and cam follower associated with the blade and blade support.

11. In a machine for cutting a multi-ply layup of sheet material, the improvement of claim 10 wherein the blade support comprises a sleeve extending coaxially of the perpendicular axis and having a spiral slot extending along the inner surface of the sleeve as the cam, and the blade includes a tang engaged with the spiral slot as the cam follower.

* * * * *